US006603375B2

(12) United States Patent
Pance

(10) Patent No.: US 6,603,375 B2
(45) Date of Patent: Aug. 5, 2003

(54) HIGH Q COUPLINGS OF DIELECTRIC RESONATORS TO MICROSTRIP LINE

(75) Inventor: Kristi Dhimiter Pance, South Boston, MA (US)

(73) Assignee: Tyco Electronics Corp, Middletown, PA (US)

( * ) Notice: Subject to any disclaimer, the term of this patent is extended or adjusted under 35 U.S.C. 154(b) by 0 days.

(21) Appl. No.: 09/904,685

(22) Filed: Jul. 13, 2001

(65) Prior Publication Data

US 2003/0011448 A1 Jan. 16, 2003

(51) Int. Cl.[7] ..... H01P 7/10
(52) U.S. Cl. ..... 333/219.1; 333/246
(58) Field of Search ..... 333/219.1, 246, 333/202, 223, 224, 205

(56) References Cited

U.S. PATENT DOCUMENTS

| | | | | | |
|---|---|---|---|---|---|
| 4,477,785 | A | * | 10/1984 | Atia | 333/202 |
| 4,821,006 | A | | 4/1989 | Ishikawa et al. | 333/202 |
| 4,835,498 | A | * | 5/1989 | Rouger et al. | 333/219.1 |
| 5,140,285 | A | * | 8/1992 | Cohen | 331/96 |
| 5,218,330 | A | * | 6/1993 | Omiya et al. | 333/223 |
| 5,525,945 | A | * | 6/1996 | Chiappetta et al. | 333/202 |
| 5,841,330 | A | * | 11/1998 | Wenzel et al. | 333/202 |

FOREIGN PATENT DOCUMENTS

WO WO 01/43221 A1 6/2001 ..... H01P/1/208

OTHER PUBLICATIONS

D. Kajfez and P. Guillon (editors), *Dielectric Resonators,* ISBN 0–89006–201–3, Publisher Artech House, Dedham, MA 1986, pp. 298–317.

*Quantum Proximity Resonances*, E.J. Heller, Physical Review Letters, vol. 77, No. 20, Nov. 11, 1996, The American Physical Society, pp. 4122–4125.

*Tunneling Proximity Resonances: Interplay between Symmetry and Dissipation*, Kristi Pance, et al., Physics Department, Northeastern University, Aug. 2, 1999, T–143, pp. 16–18, F426.

*Observation of Proximity Resonances in a Parallel–Plate Waveguide*, J.S. Hersch, et al., Physical Review Letters, vol. 81, No. 15, Oct. 12, 1998, The American Physical Society, pp. 3059–3062.

Patent abstract of Japan, publication No. 05267940, publication dated Oct. 15, 1993, application No. 04092159, application date Mar. 18, 1992.

Patent abstract of Japan, publication No. 01144701, publication date Jun. 7, 1989, application No. 62304286, application dated Nov. 30, 1987.

Patent abstract of Japan, publication No. 02137502, publication date May 25, 1990, application No. 63292599, application date Nov. 18, 1988.

* cited by examiner

*Primary Examiner*—Robert Pascal
*Assistant Examiner*—Dean Takaoka

(57) ABSTRACT

A configuration for coupling a dielectric resonator to a microstrip transmission line that maintains a relatively high Q value of the dielectric resonator. The dielectric resonator-to-microstrip transmission line coupling configuration includes a dielectric resonator, a metal wall, and a microstrip conductor mounted on a dielectric substrate surface such that the dielectric resonator is near the microstrip conductor. The dielectric resonator is configured to resonate in an intrinsic non-radiating hybrid electromagnetic mode, and the metal wall is configured as a mirror for conceptually forming an image of the resonating dielectric resonator. When an electromagnetic wave is transmitted on the microstrip transmission line, the dielectric resonator is excited to resonate in the hybrid electromagnetic mode, thereby allowing electromagnetic field coupling between the microstrip transmission line and the dielectric resonator, while maintaining a high Q value of the dielectric resonator.

15 Claims, 6 Drawing Sheets

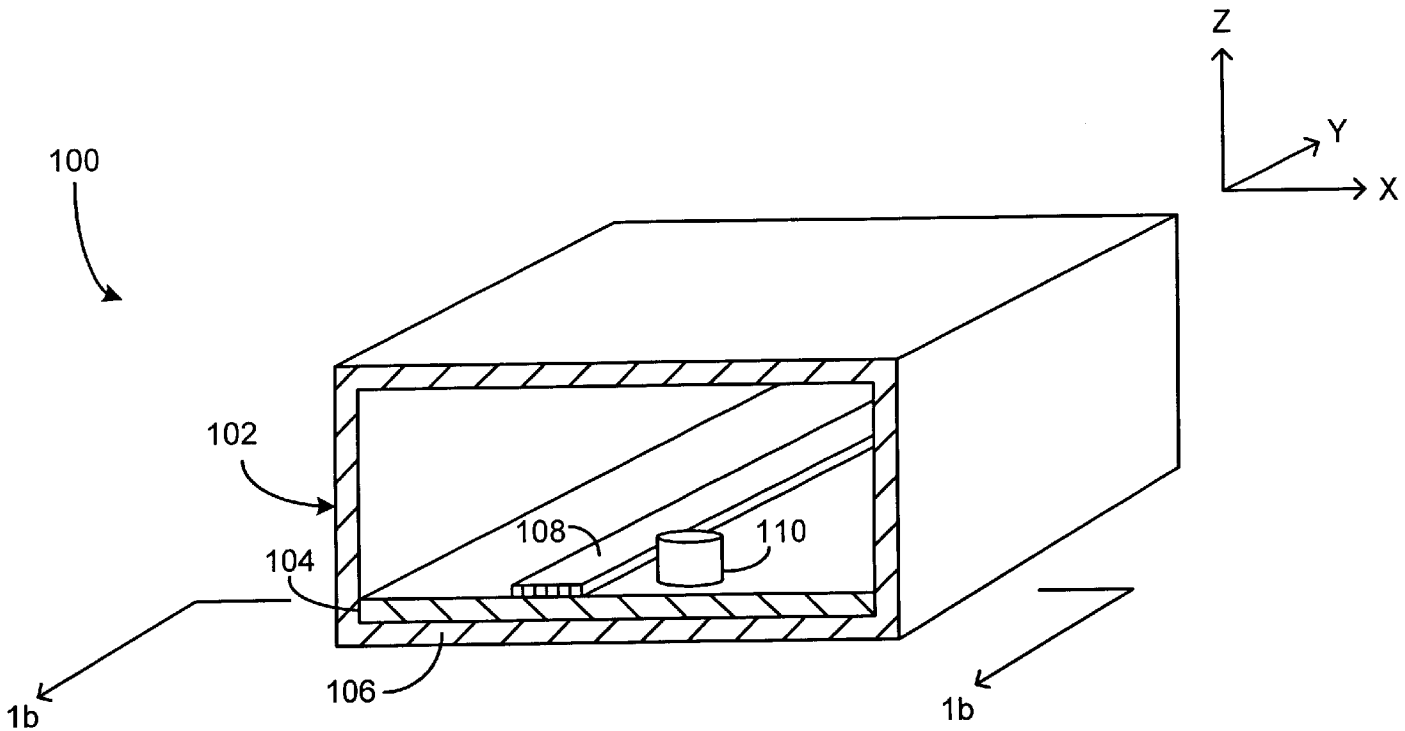
Fig. 1a - Prior Art

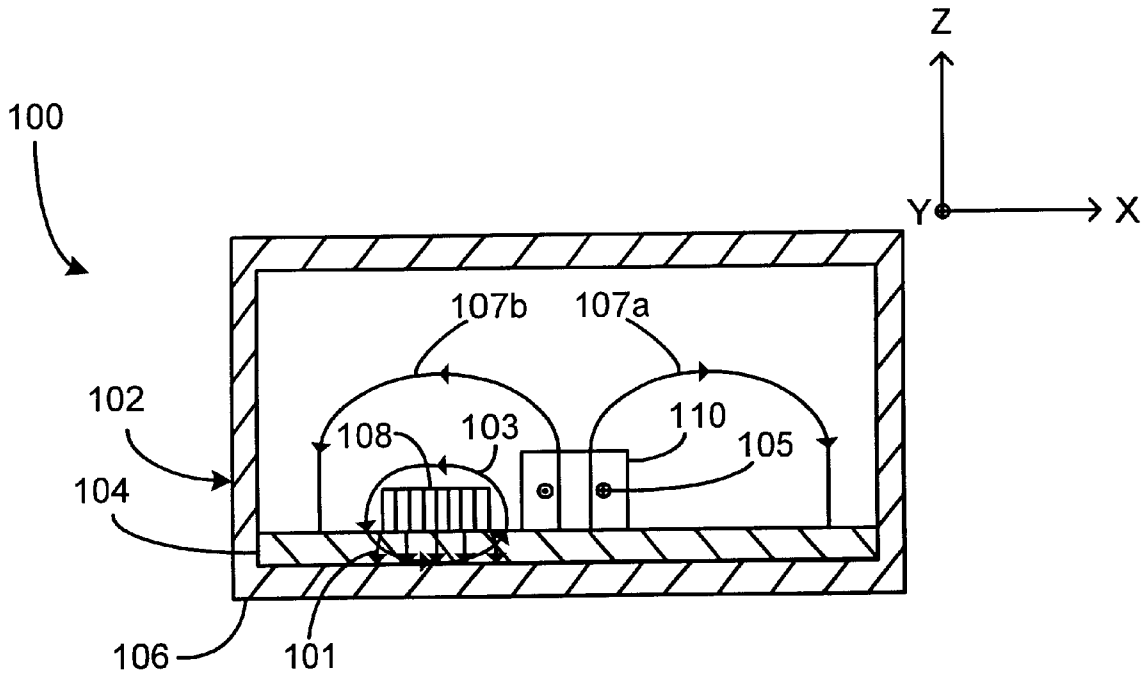
Fig. 1b - Prior Art

HIGH Q COUPLINGS OF DIELECTRIC RESONATORS TO MICROSTRIP LINE

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

The present invention relates generally to configurations for coupling dielectric resonators to transmission lines, and more specifically to a configuration for coupling a dielectric resonator to a microstrip transmission line in which a very high Q value of the dielectric resonator is maintained.

Dielectric resonators are frequently employed in microwave circuits such as microwave oscillators and filters because of their relatively high Quality factor (Q) values and good frequency stability. In a conventional configuration for coupling a dielectric resonator to a microstrip transmission line in a microwave circuit application, the dielectric resonator is mounted on a dielectric substrate near an adjacent microstrip conductor. Further, the dielectric substrate is disposed on a ground plane such that the combination of the microstrip conductor, the dielectric substrate, and the ground plane forms the microstrip transmission line.

In the conventional dielectric resonator-to-microstrip transmission line coupling configuration, the dielectric resonator is typically configured to resonate in either a Transverse Electric (TE) mode or a Transverse Magnetic (TM) mode. For example, when a cylindrical dielectric resonator is configured to resonate in a TE mode, an end face of the dielectric resonator cylinder may be mounted on the dielectric substrate near the adjacent microstrip conductor to allow magnetic field coupling between the dielectric resonator and the microstrip transmission line. Alternatively, when the cylindrical dielectric resonator is configured to resonate in a TM mode, the dielectric resonator cylinder may be mounted on the dielectric substrate on its side near the adjacent microstrip conductor to allow the desired magnetic field coupling between the dielectric resonator and the microstrip transmission line.

Moreover, the dielectric resonator, the adjacent microstrip transmission line, and the dielectric substrate are typically shielded by, e.g., a metal enclosure to prevent dissipative losses caused by electromagnetic fields radiating away from the dielectric resonator and the microstrip transmission line and/or undesired electromagnetic field coupling with adjacent electrical circuits.

One drawback of the conventional dielectric resonator-to-microstrip transmission line coupling configuration is that dielectric resonators in this configuration are often subject to reduced Q values. For example, the Q value of a dielectric resonator may be reduced due to substantial electromagnetic field coupling with a microstrip transmission line and/or undesired electromagnetic field coupling with a ground plane or a shield. As a result, the frequency stability of the dielectric resonator may degrade, thereby causing a corresponding degradation in the frequency stability of a microwave circuit in which the dielectric resonator is incorporated.

It would therefore be desirable to have a configuration for coupling a dielectric resonator to a microstrip transmission line that can be employed in microwave circuit applications. Such a dielectric resonator-to-microstrip transmission line coupling configuration would allow the dielectric resonator to maintain a relatively high Q value.

BRIEF SUMMARY OF THE INVENTION

In accordance with the present invention, a configuration for coupling a dielectric resonator to a microstrip transmission line is provided that maintains a relatively high Q value of the dielectric resonator. Benefits of the presently disclosed invention are achieved by configuring the dielectric resonator to resonate in an intrinsic non-radiating Hybrid Electromagnetic Mode (HEM) to optimize the distribution of electromagnetic fields, thereby minimizing dissipative losses that can lead to reduced Q values.

In a first embodiment, a dielectric resonator, a grounded metal wall, and a microstrip conductor are mounted on a surface of a dielectric substrate such that the microstrip conductor is between the adjacent dielectric resonator and the metal wall. Further, the dielectric substrate is disposed on a ground plane such that the combination of the microstrip conductor, the dielectric substrate, and the ground plane forms a microstrip transmission line.

The dielectric resonator is configured to resonate in a first predetermined HEM mode to generate at least one Transverse Magnetic (TM) multipole (i.e., dipole, quadrupole, or octupole, etc.) inside the resonating dielectric resonator, and the metal wall is configured as a mirror for conceptually forming an image of the resonating dielectric resonator on an opposite side of the metal wall. Further, the dielectric resonator is mounted on the dielectric substrate surface very near or touching the microstrip conductor, and the metal wall is mounted at a predetermined distance from the dielectric resonator to excite in full strength (i.e., higher Quality factor (Q)) the first predetermined HEM mode. Accordingly, when an electromagnetic wave is transmitted on the microstrip transmission line, the adjacent dielectric resonator is excited to resonate in the first predetermined HEM mode, thereby allowing a degree of magnetic field coupling between the microstrip transmission line and the dielectric resonator.

In a second embodiment, the dielectric resonator, the grounded metal wall, and the microstrip conductor are mounted on the dielectric substrate surface such that the dielectric resonator is between the adjacent microstrip conductor and the metal wall. Further, the dielectric resonator is mounted very near or touching the microstrip conductor, and the metal wall is mounted at the above-mentioned predetermined distance from the dielectric resonator. Accordingly, when an electromagnetic wave is transmitted on the microstrip transmission line, the adjacent dielectric resonator is excited to resonate in the first predetermined HEM mode to generate at least one TM multipole inside the dielectric resonator and allow a degree of magnetic field coupling between the microstrip transmission line and the dielectric resonator.

By configuring the dielectric resonator to resonate in an intrinsic non-radiating HEM mode to generate TM multipoles inside the dielectric resonator, and configuring the grounded metal wall as a mirror for conceptually forming an image of the resonating dielectric resonator, electric and magnetic fields associated with the dielectric resonator are confined to different locations. Specifically, the electric field is confined almost entirely outside the dielectric resonator in a region between the dielectric resonator and its image, and the magnetic field is confined almost entirely inside the dielectric resonator. As a result, dissipative losses are reduced to approximately zero, thereby allowing the dielectric resonator to maintain a very high Q value. Moreover, a loose coupling is achieved between the dielectric resonator and the microstrip transmission line in this configuration. As a result, the dielectric resonator maintains the very high Q value in both unloaded and loaded configurations.

In a third embodiment, the dielectric resonator, a magnetic wall, and the microstrip conductor are mounted on the dielectric substrate surface such that the microstrip conductor is between the adjacent dielectric resonator and the magnetic wall. The dielectric resonator is configured to resonate in a second predetermined HEM mode to generate at least one Transverse Electric (TE) multipole (i.e., dipole, quadrupole, or octupole, etc.) inside the dielectric resonator, and the magnetic wall is configured as a mirror. Further, the dielectric resonator is mounted on the dielectric substrate surface near but not touching the microstrip conductor, and the magnetic wall is mounted at a predetermined distance from the dielectric resonator to excite in full strength (i.e., higher Q) the second predetermined HEM mode. Accordingly, when an electromagnetic wave is transmitted on the microstrip transmission line, the adjacent dielectric resonator is excited to resonate in the second predetermined HEM mode to allow a relatively stronger magnetic field coupling between the microstrip transmission line and the dielectric resonator.

In a fourth embodiment, the dielectric resonator, the magnetic wall, and the microstrip conductor are mounted on the dielectric substrate surface such that the dielectric resonator is between the adjacent microstrip conductor and the magnetic wall. Further, the dielectric resonator is mounted near but not touching the microstrip conductor, and the magnetic wall is mounted at the above-mentioned predetermined distance from the dielectric resonator to excite the second predetermined HEM mode and generate at least one TE multipole inside the dielectric resonator. Accordingly, in this fourth embodiment, when an electromagnetic wave is transmitted on the microstrip transmission line, the adjacent dielectric resonator is excited to resonate in the second predetermined HEM mode to allow the relatively stronger magnetic field coupling between the microstrip transmission line and the dielectric resonator.

By configuring the dielectric resonator to resonate in an intrinsic non-radiating HEM mode to generate TE multipoles inside the dielectric resonator, and configuring the magnetic wall as a mirror for conceptually forming an image of the resonating dielectric resonator, a relatively stronger coupling is achieved between the dielectric resonator and the microstrip transmission line while maintaining high Q values of the dielectric resonator.

Other features, functions, and aspects of the invention will be evident from the Detailed Description of the Invention that follows.

BRIEF DESCRIPTION OF THE SEVERAL VIEWS OF THE DRAWING

The invention will be more fully understood with reference to the following Detailed Description of the Invention in conjunction with the drawings of which:

FIG. 1*a* is a perspective view of a conventional dielectric resonator-to-microstrip transmission line coupling configuration;

FIG. 1*b* is an end view of the conventional dielectric resonator-to-microstrip transmission line coupling configuration illustrated in FIG. 1*a*, in which representations of electromagnetic fields associated with a dielectric resonator and a microstrip transmission line are shown;

DETAILED DESCRIPTION OF THE INVENTION

Figure 2A:
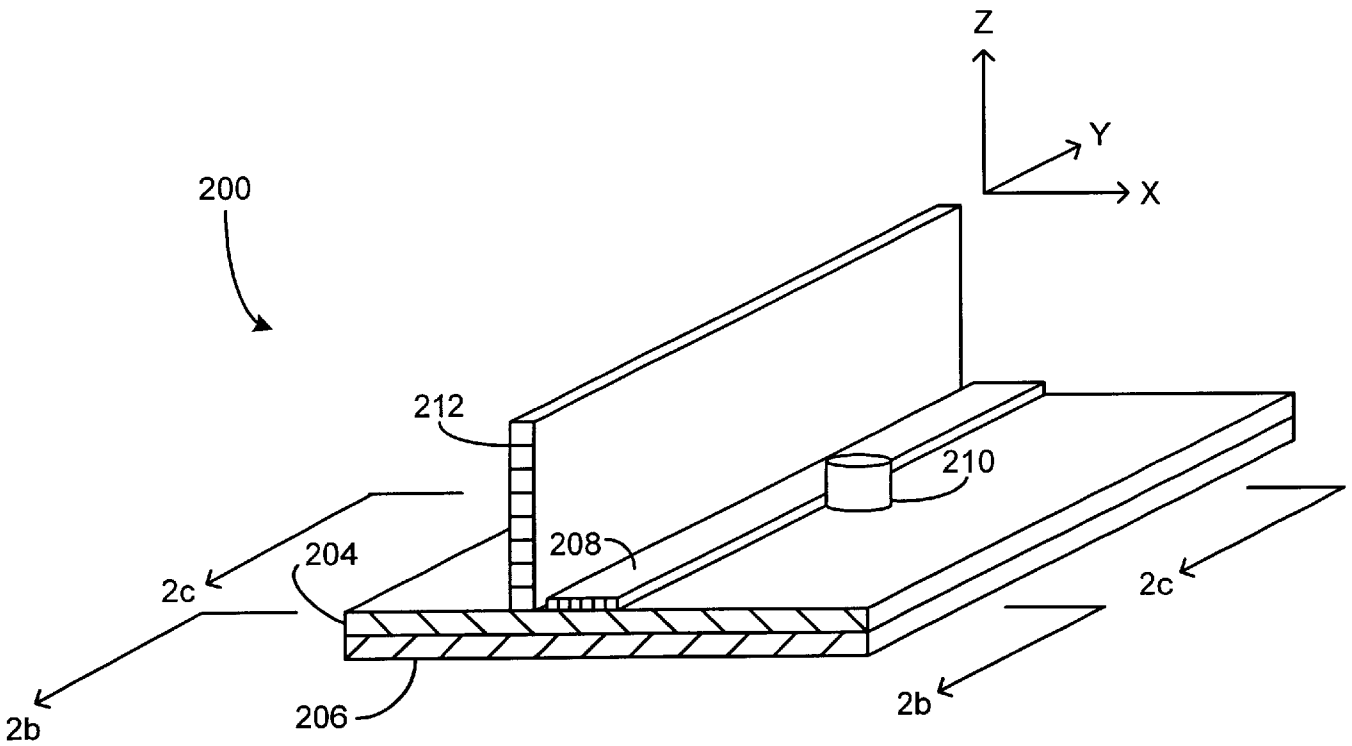
FIG. 2*a* is a perspective view of a dielectric resonator-to-microstrip transmission line coupling configuration according to the present invention.

A configuration for coupling a dielectric resonator to a microstrip transmission line is disclosed in which a very high Quality factor (Q) value of the dielectric resonator is maintained. In the presently disclosed dielectric resonator-to-microstrip transmission line coupling configuration, the dielectric resonator is configured to resonate in an intrinsic non-radiating Hybrid Electromagnetic Mode (HEM) to optimize the distribution of electromagnetic fields, thereby minimizing dissipative losses that can cause reduced Q values.

FIG. 1*a* depicts a perspective view of a conventional configuration 100 for coupling a dielectric resonator to a microstrip transmission line, which may be employed in microwave circuit applications. In the conventional dielectric-to-microstrip transmission line coupling configuration 100, a dielectric resonator 110 and a microstrip conductor 108 are mounted on a surface of a dielectric substrate 104 such that the dielectric resonator 110 is near the adjacent microstrip conductor 108. It is noted that the dielectric resonator 110 is shaped as a cylinder, and an end face of the cylindrical dielectric resonator 110 is mounted on the dielectric substrate surface.

The dielectric substrate 104 including the dielectric resonator 110 and the microstrip conductor 108 mounted thereon are disposed in and shielded by a grounded metal enclosure 102 to minimize dissipative losses. Further, the dielectric substrate 104 is disposed on a portion 106 of the grounded metal enclosure 102 configured as a ground plane. Accordingly, the combination of the microstrip conductor 108, the dielectric substrate 104, and the ground plane 106 forms a microstrip transmission line (not numbered).

For example, the dielectric resonator 110 may be configured to resonate in a Transverse Electric (TE) azimuthally-symmetric mode. The electric field associated with the TE mode is typically strongest inside the dielectric resonator 110 within a plane passing through the center of the dielectric resonator 110 and parallel to the x–y plane (also known as the "equatorial plane"), except in the vicinity of the center of the dielectric resonator 110 where the electric field is relatively weak or zero. Further, the magnetic field associated with the TE mode is perpendicular to the electric field and typically strongest down the center of the dielectric resonator 110 within a plane containing the z-axis (also known as a "meridian plane").

The microstrip transmission line comprising the microstrip conductor 108 has an electric field that is typically strongest inside the microstrip transmission line within a plane containing the z-axis (i.e., perpendicular to the ground plane 106), and a magnetic field that is perpendicular to the electric field and typically strongest outside the microstrip transmission line.

FIG. 1*b* depicts an end view of the conventional dielectric resonator-to-microstrip transmission line coupling configuration 100, in which representations of electromagnetic fields of the dielectric resonator 110 and the microstrip conductor 108 are shown. As described above, the electric field associated with the TE mode is strongest inside the dielectric resonator 110 within the equatorial plane, and the magnetic field associated with the TE mode is perpendicular to the electric field and strongest down the center of the dielectric resonator 110 within a meridian plane. Accordingly, FIG. 1*b* depicts portions of an electric field line 105 inside the dielectric resonator 110 within the equatorial plane, and magnetic field lines 107*a* and 107*b* perpendicular to the electric field line 105 and passing in the vicinity of the center of the dielectric resonator 110 within a meridian plane. As shown in FIG. 1*b*, the magnetic field lines 107*a* and 107*b* radiate symmetrically outside the dielectric resonator 110 from the approximate center of the dielectric resonator 110.

FIG. 1*b* further depicts electric field lines 101 inside the microstrip transmission line and in a direction perpendicular to the ground plane 106, and a magnetic field line 103 generally perpendicular to the electric field lines 101 and encompassing the microstrip conductor 108. As shown in FIG. 1*b*, the magnetic field line 107*b* of the dielectric resonator 110 effectively links with the magnetic field line 103 of the microstrip transmission line. Accordingly, in the conventional dielectric-to-microstrip transmission line coupling configuration 100, the respective magnetic field configurations of the dielectric resonator 110 and the microstrip transmission line allow substantial magnetic field coupling between the dielectric resonator 110 and the adjacent microstrip transmission line.

It is noted that the dielectric resonator 110 in the conventional dielectric-to-microstrip transmission line coupling configuration 100 is subject to reduced Q values. The Q value of a dielectric resonator is herein defined as the ratio between the energy stored in the dielectric resonator to the energy lost or dissipated from the dielectric resonator.

For example, the Q value of the dielectric resonator 110 may be reduced in consequence of its close proximity to the ground plane 106, which can cause dissipative losses due to substantial magnetic or electric field coupling between the dielectric resonator 110 and the ground plane 106. Because the Q value of a dielectric resonator is herein defined as the ratio between the energy stored in the dielectric resonator to the energy dissipated from the dielectric resonator, the substantial magnetic or electric field coupling between the dielectric resonator 110 and the ground plane 106 can lead to increased energy dissipation and corresponding reductions in the Q value of the dielectric resonator 110.

It is further noted that an "unloaded" Q value of a dielectric resonator is herein defined as the intrinsic Q value of the dielectric resonator, and a "loaded" Q value of a dielectric resonator is herein defined as the Q value of the dielectric resonator after it is incorporated in an electrical circuit. Because there is substantial magnetic or electric field coupling between the dielectric resonator 110 and the adjacent microstrip transmission line (and the ground plane 106) in the electrical circuit configuration depicted in FIG. 1*b*, increased energy dissipation and radiation may cause the loaded Q value of the dielectric resonator 110 to be significantly less than the corresponding unloaded Q value. For example, in the conventional dielectric resonator-to-microstrip transmission line coupling configuration 100 (which is operating in the TE mode), the loaded Q value of the dielectric resonator 110 may be less than or equal to about 250, while the corresponding unloaded Q value may be equal to about 10,000.

FIG. 2*a* depicts a perspective view of an illustrative embodiment of a dielectric resonator-to-microstrip transmission line coupling configuration 200 that may be employed in microwave circuit applications, in accordance with the present invention. In the illustrated embodiment, a dielectric resonator 210, a grounded metal wall 212, and a microstrip conductor 208 are mounted on a surface of a dielectric substrate 204 such that the microstrip conductor 208 is between the adjacent dielectric resonator 210 and the metal wall 212.

It is noted that the dielectric resonator 210 is illustrated in FIG. 2*a* as being cylinder-shaped, and an end face of the cylindrical dielectric resonator 210 is mounted to the surface of the dielectric substrate 204. However, it is understood that the dielectric resonator 210 may take alternative forms, and may be mounted to the dielectric substrate surface in orientations different from that shown in FIG. 2*a*. Moreover, the metal wall 212 may be made of gold or silver or any other suitable metal.

The dielectric substrate 204 including the dielectric resonator 210, the metal wall 212, and the microstrip conductor 208 mounted thereon are disposed on a ground plane 206. Further, the combination of the microstrip conductor 208, the dielectric substrate 204, and the ground plane 206 forms a microstrip transmission line (not numbered).

In the dielectric resonator-to-microstrip transmission line coupling configuration 200, the dielectric resonator 210 is configured to resonate in an intrinsic non-radiating HEM mode. In the illustrated embodiment, the dielectric resonator 210 is configured to resonate in a hybrid TM—TM anti-symmetric mode to provide multiple TM—TM interactions, thereby generating TM multipoles (i.e., dipole, quadrupole, or octupole, etc.) inside the resonating dielectric resonator 210. Further, the metal wall 212 is configured as a mirror for conceptually forming an image of the resonating dielectric resonator 210 on an opposite side of the metal wall 212. Moreover, the dielectric resonator 210 is mounted on the dielectric substrate surface very near or touching the microstrip conductor 208, and the metal wall 212 is mounted at a predetermined distance from the dielectric resonator 210 to excite in full strength (i.e., higher Q) the hybrid TM—TM anti-symmetric mode. Accordingly, when an electromagnetic wave is transmitted on the microstrip transmission line, the adjacent dielectric resonator 210 is excited to resonate in the hybrid TM—TM anti-symmetric mode to allow a degree of magnetic field coupling between the microstrip transmission line and the dielectric resonator 210.

It should be noted that in the dielectric resonator-to-microstrip transmission line coupling configuration 200, the dielectric resonator 210 preferably has a relatively small size to allow more efficient electromagnetic field coupling. It is also noted that electromagnetic fields associated with the hybrid TM—TM anti-symmetric mode in this configuration are essentially confined to different locations, as further described below.

Figure 2B:
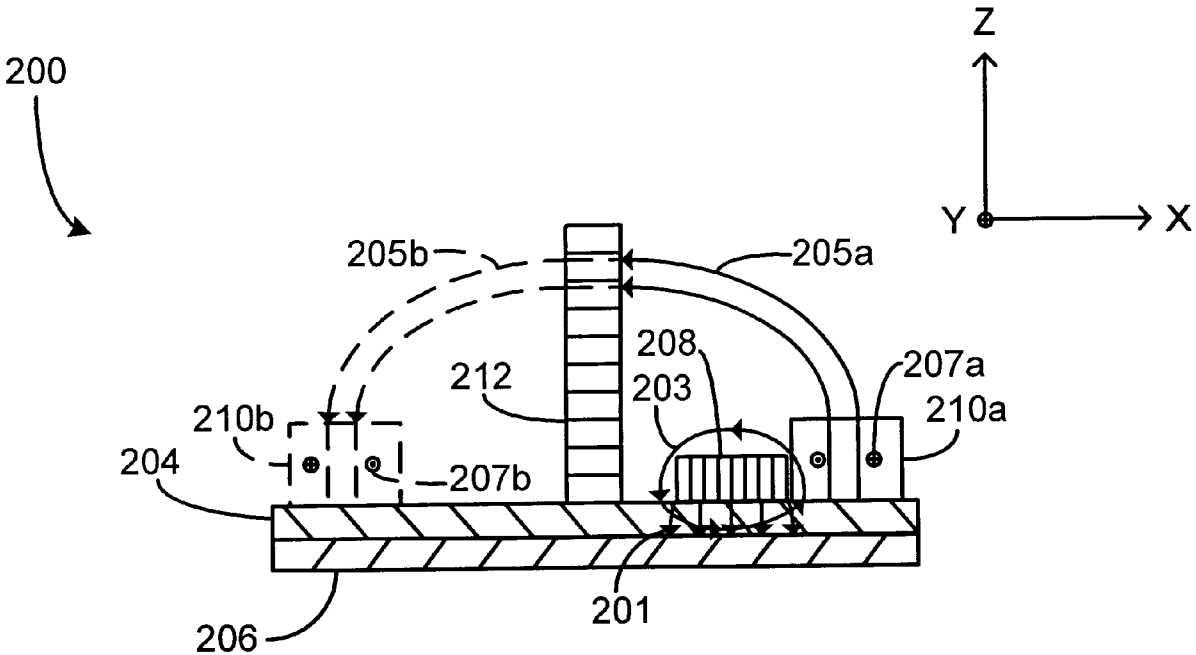
FIG. 2*b* is an end view of the dielectric resonator-to-microstrip transmission line coupling configuration illustrated in FIG. 2*a*, in which representations of electromagnetic fields associated with a dielectric resonator, an image of the dielectric resonator, and a microstrip transmission line are shown.

FIG. 2*b* depicts an end view of the dielectric resonator-to-microstrip transmission line coupling configuration 200, in which representations of the electromagnetic fields of the dielectric resonator 210*a* and the microstrip conductor 208 are shown. As described above, the grounded metal wall 212 acts as a mirror for conceptually forming an image of the resonating dielectric resonator 210 on an opposite side of the metal wall 212. Accordingly, FIG. 2*b* depicts the dielectric resonator 210*a* on one side of the metal wall 212, and an image 210*b* of the dielectric resonator 210*a* on the opposite side of the metal wall 212.

As also described above, the electromagnetic fields of the dielectric resonator 210*a* are essentially confined to different locations. Specifically, a relatively small portion of the electric field (as represented by electric field lines 205*a*) of the dielectric resonator 210*a* passes in the vicinity of the center of the dielectric resonator 210*a* within a meridian plane, while the remaining electric field of the dielectric resonator 210*a* is concentrated outside the dielectric resonator 210*a*. In the illustrated embodiment, the electric field associated with the hybrid TM—TM anti-symmetric mode and its multiples is strongest in the region between the dielectric resonator 210*a* and its image 210*b*.

Similarly, a relatively small portion of an image of the electric field (as represented by electric field image lines 205*b*) passes in the vicinity of the center of the dielectric resonator image 210*b* within a meridian plane, while the remaining electric field image is concentrated outside the dielectric resonator image 210*b*.

Moreover, the magnetic field of the dielectric resonator 210*a* is confined almost entirely inside the dielectric resonator 210*a*. In the illustrated embodiment, the magnetic field associated with the hybrid TM—TM anti-symmetric mode (as represented by portions of magnetic field lines 207*a*) is perpendicular to the electric field and strongest within the equatorial plane of the dielectric resonator 210*a*, except in the vicinity of the center of the dielectric resonator 210*a* where the magnetic field is relatively weak.

Similarly, an image of the magnetic field (as represented by magnetic field image line portions 207*b*) is confined almost entirely inside the dielectric resonator image 210*b*. Accordingly, the magnetic field image is perpendicular to the electric field image and strongest within the equatorial plane of the dielectric resonator image 210*b*, except in the vicinity of the center of the dielectric resonator image 210*b* where the magnetic field image is relatively weak.

It should be noted that the images of the dielectric resonator and its associated electromagnetic fields as herein described are merely conceptual and not physical constructs. The conceptual dielectric resonator image 210*b* and the conceptual electromagnetic field images 205*b* and 207*b* are herein employed to simplify the analysis of the electromagnetic field interactions of the presently disclosed invention.

FIG. 2*b* further depicts an electric field (as represented by electric field lines 201) inside the microstrip transmission line and in a direction perpendicular to the ground plane 206, and a magnetic field (as represented by a magnetic field line 203) generally perpendicular to the electric field and encompassing the microstrip conductor 208.

Because the magnetic field associated with the hybrid TM—TM anti-symmetric mode is confined almost entirely inside and within the equatorial plane of the dielectric resonator 210*a*, dissipative losses due to magnetic field radiation and magnetic field coupling between the dielectric resonator 210*a* and the microstrip transmission line (and the ground plane 206) are reduced to approximately zero. It is noted that the imaginary part of the magnetic permeability of the dielectric resonator 210*a* resonating in this hybrid TM—TM anti-symmetric mode is equal to approximately zero, which implies that the magnetic losses inside the dielectric resonator 210*a* are approximately zero.

Further, because the electric field and the electric field image associated with the hybrid TM—TM anti-symmetric mode are concentrated almost entirely outside the dielectric resonator 210*a* and the dielectric resonator image 210*b*, respectively, electric field dipoles associated with the dielectric resonator 210*a* and the dielectric resonator image 210*b* effectively cancel each other out. As a result, dissipative losses due to electric field radiation are also reduced to approximately zero.

By confining the magnetic field almost entirely inside the dielectric resonator 210*a* and concentrating the electric field almost entirely outside the dielectric resonator 210*a* to minimize radiation, and by providing a relatively loose coupling for TM—TM multiples between the dielectric resonator 210*a* and the microstrip transmission line, a very high Q value of the dielectric resonator 210*a* can be maintained. It is noted that because energy dissipation is substantially reduced in this coupling configuration, the dielectric substrate 204 including the dielectric resonator 210 and the microstrip conductor 208 mounted thereon (see FIG. 2*a*) need not be shielded by, e.g., a grounded metal enclosure.

Moreover, because the dielectric resonator 210*a* is only loosely coupled to the microstrip transmission line in the electrical circuit configuration depicted in FIG. 2*b*, the dielectric resonator 210*a* maintains very high Q values in both the loaded and unloaded configurations. For example, the Q value in the loaded configuration may be in a range from about 3,000 to 4,000, and the Q value in the unloaded configuration may be in a range from about 20,000 to 300,000.

Figure 2C:
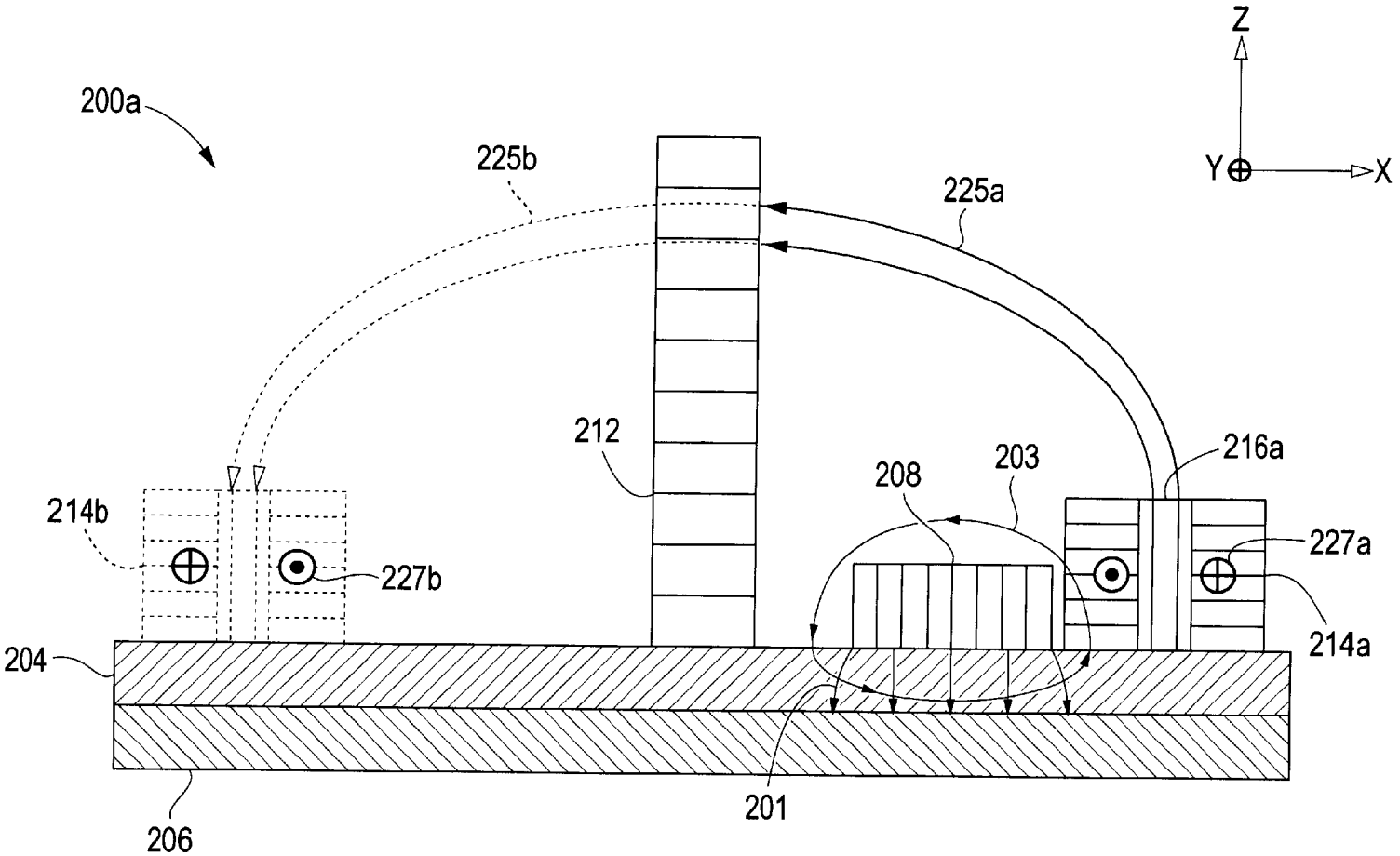
FIG. 2*c* is a cross-sectional view of a first alternative embodiment of the dielectric resonator-to-microstrip transmission line coupling configuration illustrated in FIG. 2*a*, in which the dielectric resonator is replaced by a tubular dielectric resonator.

FIG. 2*c* depicts a cross-sectional view of an alternative embodiment 200*a* of the dielectric resonator-to-microstrip transmission line coupling configuration 200 (see FIG. 2*b*), in which the dielectric resonator 210*a* is replaced by a tubular dielectric resonator 214*a*. In this alternative embodiment, the tubular dielectric resonator 214*a* further reduces energy dissipation to maintain higher Q values.

It is noted that in the dielectric resonator-to-microstrip transmission line coupling configuration 200*a*, the tubular dielectric resonator 214*a* has a cylindrical plug removed from its center to form a hole 216*a*. Further, the tubular dielectric resonator 214*a* is configured to resonate in a hybrid TM—TM anti-symmetric mode to generate TM multipoles (i.e., dipole, quadrupole, or octupole, etc.) inside the resonating dielectric resonator 214*a*, and the metal wall 212 is configured as a mirror to form an image of the resonating dielectric resonator 214*a* on an opposite side of the wall 212. Accordingly, FIG. 2*c* depicts the tubular dielectric resonator 214*a* on one side of the metal wall 212, and an image 214*b* of the tubular dielectric resonator 214*a* on the opposite side of the wall 212.

The magnetic field and the magnetic field image associated with the hybrid TM—TM anti-symmetric mode (as represented by portions of magnetic field lines 227*a* and magnetic field image lines 227*b*) are strongest within the respective equatorial planes of the tubular dielectric resonator 214*a* and its image 214*b*, except in the vicinity of the respective centers of the dielectric resonator 214*a* and its image 214*b* where the magnetic fields are relatively weak. Further, relatively small portions of the electric field and the electric field image associated with the hybrid TM—TM anti-symmetric mode (as represented by electric field lines 225*a* and electric field image lines 225*b*) pass in the vicinity of the respective centers of the dielectric resonator 214*a* and its image 214*b* within respective meridian planes, while the strongest electric field and electric field image are concentrated outside the dielectric resonator 214*a* and its image 214*b*, respectively.

Even though the cylindrical plug is removed from the center of the tubular dielectric resonator 214*a* to form the hole 216*a*, the magnetic field is still confined almost entirely inside the dielectric resonator 214*a*, and the electric field dipoles (which effectively cancel out the electric field image dipoles) are still concentrated almost entirely outside the dielectric resonator 214*a*. As a result, dissipative losses due to electromagnetic radiation and substantial magnetic field coupling with the microstrip transmission line (and the ground plane 206) are reduced to approximately zero, and a higher Q value of the tubular dielectric resonator 214*a* is maintained. Moreover, because the tubular dielectric resonator 214*a* is only loosely coupled to the microstrip transmission line in the electrical circuit configuration depicted in FIG. 2*c*, the dielectric resonator 214*a* maintains higher Q values in both the loaded and unloaded configurations.

Figure 3:
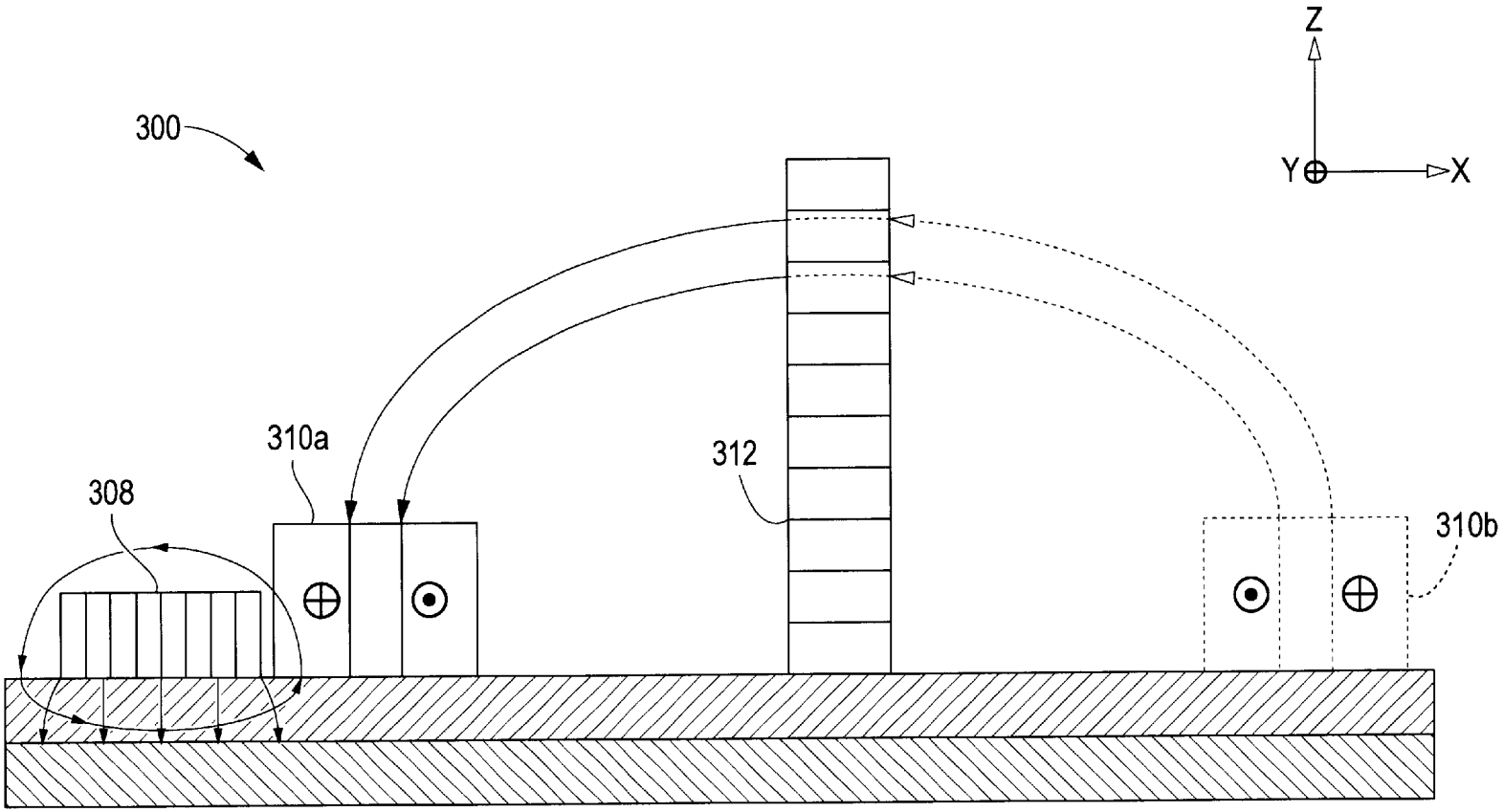
FIG. 3 is an end view of a second alternative embodiment of the dielectric resonator-to-microstrip transmission line coupling configuration illustrated in FIG. 2*a*, in which a mirror is disposed on an opposite side of the dielectric resonator.

FIG. 3 depicts an end view of another alternative embodiment 300 of the dielectric resonator-to-microstrip transmission line coupling configuration 200 (see FIG. 2*b*), in which a dielectric resonator 310*a* is disposed between an adjacent microstrip conductor 308 and a grounded metal wall 312. Like the dielectric resonator 210*a* (see FIG. 2*b*), the dielectric resonator 310*a* is configured to resonate in a hybrid TM—TM anti-symmetric mode to generate TM multipoles (i.e., dipole, quadrupole, or octupole, etc.) inside the resonating dielectric resonator 310*a*, and the metal wall 312 is configured as a mirror to form an image 310*b* of the resonating dielectric resonator 310*a* on an opposite side of the wall 312.

Further, the dielectric resonator 310*a* is mounted on a dielectric substrate surface very near or touching the microstrip conductor 308, and the metal wall 312 is mounted at a predetermined distance from the dielectric resonator 310*a* to excite in full strength (i.e., higher Q) the hybrid TM—TM anti-symmetric mode. Accordingly, when an electromagnetic wave is transmitted on a microstrip transmission line comprising the microstrip conductor 308, the adjacent dielectric resonator 310*a* is excited to resonate in the hybrid TM—TM anti-symmetric mode to allow a degree of magnetic field coupling between the microstrip transmission line and the dielectric resonator 310*a*.

Having described the above illustrative embodiments, it will be appreciated that other alternative embodiments or variations may be made. For example, it was described that the dielectric resonator 210 (see FIG. 2*a*) is configured to generate TM multipoles (i.e., dipole, quadrupole, or octupole, etc.) inside the resonating dielectric resonator 210, and the metal wall 212 (see FIG. 2*a*) is configured as a mirror to form an image of the resonating dielectric resonator 210 on an opposite side of the wall 212.

However, it is understood that an analogous dielectric resonator-to-microstrip transmission line coupling configuration may be formed by configuring the dielectric resonator to provide multiple TE—TE interactions, thereby generating TE multipoles inside the dielectric resonator. Further, the mirror may alternatively comprise a magnetic wall for conceptually forming an image of the resonating dielectric resonator on an opposite side of the wall. Moreover, the dielectric resonator may be mounted on the dielectric substrate surface near but not touching the microstrip conductor (so as not to destroy boundary conditions), and the magnetic wall may be mounted at a predetermined distance from the dielectric resonator to excite in full strength (i.e., higher Q) the TE mode generating the TE multipoles inside the dielectric resonator. It is noted that the magnetic wall may be mounted at the predetermined distance from the dielectric resonator on either side of the microstrip conductor and the adjacent dielectric resonator.

Accordingly, in this analogous coupling configuration, magnetic fields generated by the dielectric resonator radiate in an anti-symmetric manner outside the dielectric resonator from the approximate center thereof, and magnetic fields generated by the microstrip transmission line encompass the microstrip transmission line. The respective magnetic field configurations of the dielectric resonator and the microstrip transmission line therefore match to provide a relatively stronger coupling between the dielectric resonator and the microstrip transmission line, while still maintaining high Q values of the dielectric resonator.

It will be further appreciated by those of ordinary skill in the art that modifications to and variations of the above-described dielectric resonator-to-microstrip transmission line coupling configurations may be made without departing from the inventive concepts disclosed herein. Accordingly, the invention should not be viewed as limited except as by the scope and spirit of the appended claims.

What is claimed is:

1. A dielectric resonator-to-microstrip transmission line coupling configuration, comprising:

a ground plane;

a dielectric substrate disposed on the ground plane;

a dielectric resonator mounted on a surface of the dielectric substrate and configured to resonate in an intrinsic non-radiating hybrid electromagnetic mode;

a wall mounted substantially perpendicular to the dielectric substrate surface and configured as a mirror for conceptually forming an image of the resonating dielectric resonator; and a microstrip conductor mounted on the dielectric substrate surface to form a microstrip transmission line, the microstrip transmission line being configured to generate a magnetic filed when transmitting an electromagnetic wave, wherein the wall is mounted a predetermined distance from the dielectric resonator to excite the intrinsic non-radiating hybrid electromagnetic mode to generate at least one transverse magnetic multipole inside the dielectric resonator, and wherein the dielectric resonator is mounted on the dielectric substrate surface near the microstrip transmission line to allow electromagnetic field coupling between the dielectric resonator and the microstrip transmission line while maintaining a high Q value of the dielectric resonator.

2. The dielectric resonator-to-microstrip transmission line coupling configuration of claim 1 wherein a loaded Q value of the dielectric resonator ranges from about 3,000 to 4,000.

3. The dielectric resonator-to-microstrip transmission line coupling configuration of claim 1 wherein the wall comprises a grounded metal wall.

4. The dielectric resonator-to-microstrip transmission line coupling configuration of claim 1 wherein the dielectric resonator comprises a tubular dielectric resonator.

5. The dielectric resonator-to-microstrip transmission line coupling configuration of claim 1 wherein the wall comprises a magnetic wall.

6. The dielectric resonator-to-microstrip transmission line coupling configuration of claim 1 wherein the microstrip conductor is mounted on the dielectric substrate surface between the dielectric resonator and the wall.

7. The dielectric resonator-to-microstrip transmission line coupling configuration of claim 1 wherein the dielectric resonator is mounted on the dielectric substrate surface between the microstrip conductor and the wall.

8. A dielectric resonator-to-microstrip transmission line coupling configuration, comprising:

a ground plane;

a dielectric substrate disposed on the ground plane;

a dielectric resonator mounted on a surface of the dielectric substrate and configured to resonate in an intrinsic non-radiating hybrid electromagnetic mode;

a wall mounted substantially perpendicular to the dielectric substrate surface and configured as a mirror for conceptually forming an image of the resonating dielectric resonator; and a microstrip conductor mounted on the dielectric substrate surface to form a microstrip transmission line, the microstrip transmission line being configured to generate a magnetic filed when transmitting an electromagnetic wave, wherein the wall is mounted a predetermined distance from the dielectric resonator to excite the intrinsic non-radiating hybrid electromagnetic mode, and wherein the dielectric resonator is mounted on the dielectric substrate surface near the microstrip transmission line to allow electromagnetic field coupling between the dielectric resonator and the microstrip transmission line while maintaining a high Q value of the dielectric resonator wherein an unloaded Q value of the dielectric resonator ranges from about 20,000 to 300,000.

9. A method of coupling a dielectric resonator to a microstrip transmission line, comprising the steps of:

providing a dielectric substrate disposed on a ground plane;

mounting the dielectric resonator, a vertical wall, and a microstrip conductor on a surface of the dielectric substrate such that (1) the dielectric resonator is near the microstrip conductor, (2) a combination of the microstrip conductor, the dielectric substrate, and the ground plane forms the microstrip transmission line, and the wall is predetermined distance from the dielectric resonator to excite an intrinsic non-radiating hybrid electromagnetic mode in the dielectric resonator;

generating a first electromagnetic field by the microstrip transmission line transmitting an electromagnetic wave; and generating a second electromagnetic field by the dielectric resonator resonating in the intrinsic non-radiating hybrid electromagnetic mode, the first electromagnetic field being coupled to the second electromagnetic field while maintaining a high Q value of the dielectric resonator and maintaining an unloaded Q value of the dielectric resonator in a range from about 20,000 to 300,000.

10. A method of coupling a dielectric resonator to a microstrip transmission line, comprising the steps of:

providing a dielectric substrate disposed on a ground plane;

mounting the dielectric resonator, a vertical wall, and a microstrip conductor on a surface of the dielectric substrate such that (1) the dielectric resonator is near the microstrip conductor, (2) a combination of the microstrip conductor, the dielectric substrate, and the ground plane forms the microstrip transmission line, and the wall is predetermined distance from the dielectric resonator to excite an intrinsic non-radiating hybrid electromagnetic mode in the dielectric resonator;

generating a first electromagnetic field by the microstrip transmission line transmitting an electromagnetic wave; and generating a second electromagnetic field by the dielectric resonator resonating in the intrinsic non-radiating hybrid electromagnetic mode to generate at least one transverse magnetic multipole inside the dielectric resonator, the first electromagnetic field being coupled to the second electromagnetic field while maintaining a high Q value of the dielectric resonator.

11. The method of claim 10 wherein the mounting step includes mounting the microstrip conductor on the dielectric substrate surface between the dielectric resonator and the wall.

12. The method of claim 10 wherein the mounting step includes mounting the dielectric resonator on the dielectric substrate surface between the microstrip conductor and the wall.

13. The method of claim 10 wherein the second generating step includes maintaining a loaded Q value of the dielectric resonator in a range from about 3,000 to 4,000.

14. The method of claim 10 wherein the mounting step includes mounting the wall comprising a grounded metal wall on the dielectric substrate surface.

15. The method of claim 10 wherein the mounting step includes mounting the wall comprising a magnetic wall on the dielectric substrate surface.

* * * * *